US009199812B2

(12) United States Patent
Fujikura

(10) Patent No.: US 9,199,812 B2
(45) Date of Patent: Dec. 1, 2015

(54) SHEET FEEDING DEVICE, AND IMAGE FORMING APPARATUS

(71) Applicant: FUJI XEROX CO., LTD., Tokyo (JP)

(72) Inventor: Hiroaki Fujikura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/526,873

(22) Filed: Oct. 29, 2014

(65) Prior Publication Data

US 2015/0217954 A1 Aug. 6, 2015

(30) Foreign Application Priority Data

Jan. 31, 2014 (JP) ..... 2014-017935

(51) Int. Cl.

| | |
|---|---|
| ***B65H 1/00*** | (2006.01) |
| ***B65H 5/22*** | (2006.01) |
| ***G03G 15/00*** | (2006.01) |
| ***B65H 3/08*** | (2006.01) |
| ***B65H 1/04*** | (2006.01) |

(52) U.S. Cl.

CPC ..... *B65H 5/228* (2013.01); *B65H 1/04* (2013.01); *B65H 3/08* (2013.01); *G03G 15/6529* (2013.01)

(58) Field of Classification Search

CPC ..... B65H 3/48; B65H 5/22; B65H 2406/12; B65H 2406/122; B65H 2406/1222; B65H 2406/41; B65H 2406/411; B65H 2406/422; B65H 2511/12; B65H 2701/1131

USPC ..... 271/11, 90, 97, 96, 94

See application file for complete search history.

(56) References Cited

U.S. PATENT DOCUMENTS

2009/0283958 A1* 11/2009 Takahashi ..... 271/12

FOREIGN PATENT DOCUMENTS

| | | | |
|---|---|---|---|
| JP | 2009-113953 | * | 5/2009 |
| JP | 2010-105777 A | | 5/2010 |
| JP | 2010-126296 | * | 6/2010 |

OTHER PUBLICATIONS

Machine translation of Detailed Description section of JP2010-126296.*

* cited by examiner

*Primary Examiner* — Thomas Morrison
(74) *Attorney, Agent, or Firm* — Oliff PLC

(57) ABSTRACT

Provided is a sheet feeding device including a first arrangement member that abuts an end portion in a width direction of a fed and stacked sheet material, arranges the width direction of the sheet material, and forms a first blown-out port, a second arrangement member that is mounted on the first arrangement member, is disposed in a sheet material side with respect to the first arrangement member, abuts an end portion in a width direction of a small sheet material having a narrower width than the sheet material arranged by the first arrangement member, arranges the width direction of the small sheet material, and forms a second blown-out port, and a passage member that forms a passage introducing the air blown out from the first blown-out port to the second blown-out port.

6 Claims, 11 Drawing Sheets

SHEET FEEDING DEVICE, AND IMAGE FORMING APPARATUS

CROSS-REFERENCE TO RELATED APPLICATIONS

This application is based on and claims priority under 35 USC 119 from Japanese Patent Application No. 2014-017935 filed Jan. 31, 2014.

BACKGROUND

Technical Field

The present invention relates to a sheet feeding device, and an image forming apparatus.

SUMMARY

According to an aspect of the invention, there is provided a sheet feeding device including:

a first arrangement member that abuts an end portion in a width direction of a fed and stacked sheet material, arranges the width direction of the sheet material, and forms a first blown-out port from which air sprayed to the end portion in the width direction of the sheet material is blown out;

a second arrangement member that is mounted on the first arrangement member, is disposed in a sheet material side with respect to the first arrangement member, abuts an end portion in a width direction of a small sheet material having a narrower width than the sheet material arranged by the first arrangement member, arranges the width direction of the small sheet material, and forms a second blown-out port from which air sprayed to the end portion in the width direction of the stacked small sheet material is blown out; and a passage member that forms a passage introducing the air blown out from the first blown-out port to the second blown-out port.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1B:
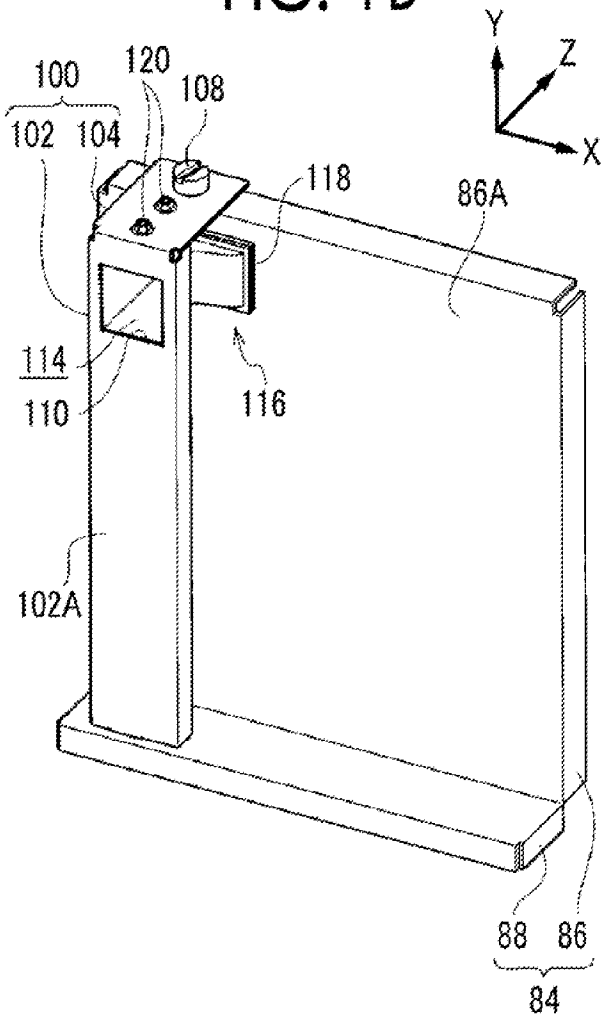
FIGS. 1A and 1B are perspective views showing a side guide and a small guide used in a sheet feeding device according to a first exemplary embodiment of the present invention.

Examples of a sheet feeding device and an image forming apparatus according to a first exemplary embodiment of the present invention will be described with reference to FIGS. 1A to 8. Moreover, in the drawings, an arrow Y direction indicates a vertical direction and an up-down direction of an apparatus, an arrow X direction indicates a horizontal direction and a width direction of the apparatus, and an arrow Z direction indicates the horizontal direction and a depth of the apparatus.

Overall Configuration of Image Forming Apparatus

Figure 8:
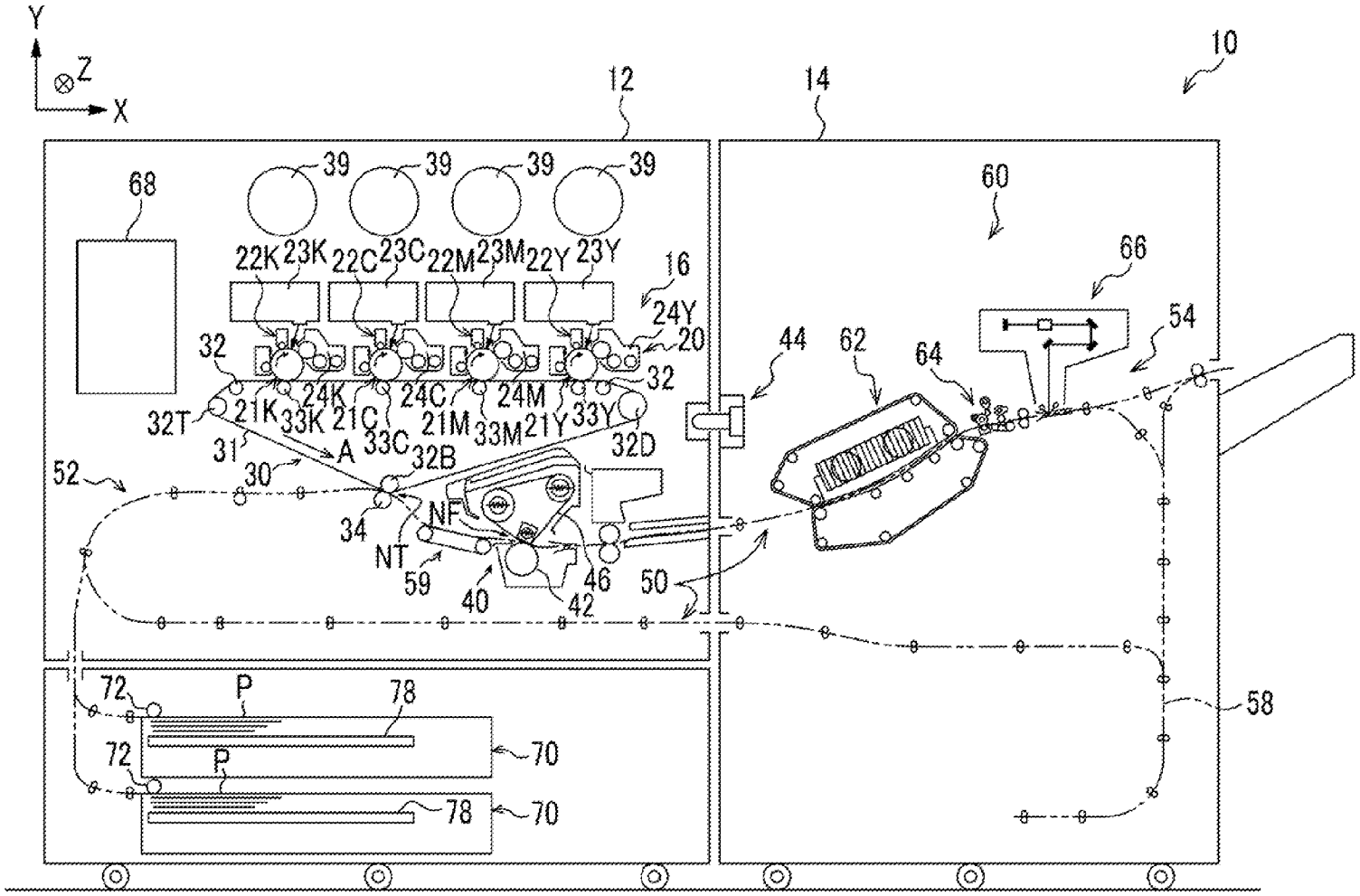
FIG. 8 is a schematic configurational diagram showing the image forming apparatus according to the first exemplary embodiment of the present invention.

As shown in FIG. 8, an image forming apparatus 10 is configured to include a first housing 12, a second housing 14, an image forming portion 16, a medium transport portion 50, a post-processing portion 60, and a control portion 68. Moreover, the control portion 68 controls each portion configuring the image forming apparatus 10 (each portion or the like configuring the image forming portion 16).

In addition, the first housing 12 and the second housing 14 are disposed to be arranged in a width direction of the apparatus, and are connected to each other by a connection mechanism 44.

Image Forming Portion 16

Figure 7:
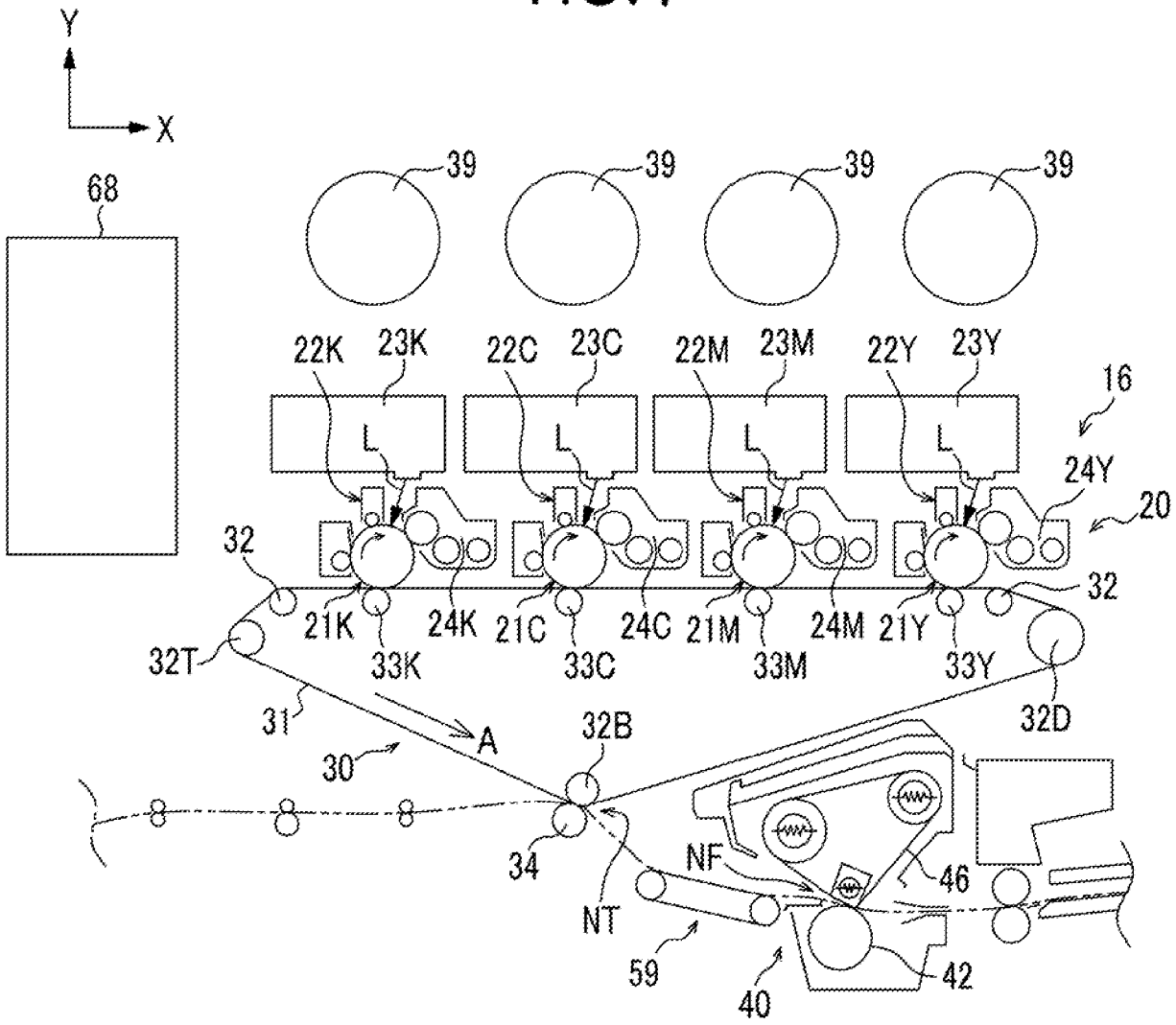
FIG. 7 is a configurational diagram showing a toner image forming portion or the like of an image forming apparatus according to the first exemplary embodiment of the present invention.

The image forming portion 16 is disposed in the inner portion of the first housing 12, and as shown in FIG. 7, is configured to include a toner image forming portion 20 which forms a toner image, a transfer device 30 which transfers an image formed by the toner image forming portion 20 to a sheet material P which is a recording medium, and a fixing device 40 which fixes the toner image transferred to the sheet material P to the sheet material P. In addition, the image forming portion 16 forms the image on the sheet material P by an electro-photographic method.

Toner Image Forming Portion 20

The toner image forming portion 20 is configured to include a photosensitive drum 21 which is an image holding member, a charging unit 22, an exposure device 23, and a developing device 24. Plural toner image forming portions 20 are provided to form the toner image for each color. In the present embodiment, a total of four toner image forming portions 20 for yellow (Y), magenta (M), cyan (C), and black (K) are provided. In addition, the toner image forming portions 20 for each color have a similar configuration. In addition, in a circumferential direction of a transfer belt 31 included in the transfer device 30, the photosensitive drum 21 of the toner image forming portion 20 for each color comes into contact with the transfer belt 31 in the order of yellow (Y), magenta (M), cyan (C), and black (K) from the upstream side. In addition, the toner image forming portions 20 for each color are disposed to be arranged in the width direction of the apparatus. Moreover, when it is not necessary to distinguish and describe Y, M, C, and K, Y, M, C, and K may be omitted.

The photosensitive drum 21 is formed in a cylindrical shape, and is driven to be rotated around its own axis by a driving unit (not shown). As one example, a photosensitive layer exhibiting a negative charging polarity is formed on the outer circumferential surface of the photosensitive drum 21.

The charging unit 22 comes into contact with the outer circumferential surface (photosensitive layer) of the photosensitive drum 21, and charges the outer circumferential surface of the photosensitive drum 21 to a negative polarity while being rotated following the rotating photosensitive drum 21.

The exposure device 23 forms an electrostatic latent image on the outer circumferential surface of the photosensitive drum 21. Specifically, modulated exposure light L is radiated to the outer circumferential surface of the photosensitive drum 21 charged by the charging unit 22 according to image data received from an image signal processing portion configuring the control portion 68. In addition, an electrostatic latent image is formed on the outer circumferential surface of the photosensitive drum 21 by the radiation of the exposure light L.

In the present embodiment, the exposure device 23 is configured to expose the outer circumferential surface of the photosensitive drum 21 while performing scanning of the light beam radiated from a light source (not shown) by a light scanning unit (optical system) including a polygon mirror or an Fθ lens.

The developing device 24 develops the electrostatic latent image formed on the outer circumferential surface of the photosensitive drum 21 as a toner image by a developer G including toner T and a carrier CA, and forms the toner image on the outer circumferential surface of the photosensitive drum 21. A powder accommodating container 39 (toner cartridge) for replenishing the toner T to the developing device 24 is connected to the developing device 24 via a transport path (not shown). The powder accommodating containers 39 for each color are disposed to be arranged in the width direction of the apparatus above the exposure device 23, and may be individually mounted and detached (may be replaced) to the first housing 12.

The transfer device 30 includes the endless transfer belt 31 to which the toner image of the photosensitive drum 21 for each color is transferred, and the transfer belt 31 is wound on plural rollers 32 and the posture of the transfer belt is determined. In the present embodiment, the posture of the transfer belt 31 is a reverse obtuse-angle triangle which is long in the width direction of the apparatus when viewed from the front side.

Among the plural rollers 32, a roller 32D functions as a driving roller which circulates the transfer belt 31 in an arrow A direction by the power of a motor (not shown). In addition, among the plural rollers 32, a roller 32T functions as a tension applying roller which applies tension to the transfer belt 31. Among the plural rollers 32, a roller 32B functions as a roller opposing a secondary image transfer roller 34 described below.

In addition, a primary image transfer roller 33, which transfers the toner image formed on the outer circumferential surface of the photosensitive drum 21 to the transfer belt 31, is disposed on a side opposite to each photosensitive drum 21 with respect to the transfer belt 31.

In addition, the secondary image transfer roller 34, which transfers the toner image transferred to the transfer belt 31 to the sheet material P, comes into contact with the apex of the lower end side configuring the obtuse angle of the transfer belt 31, and a transfer nip NT is formed by the transfer belt 31 and the secondary image transfer roller 34.

The fixing device 40 fixes the toner image on the sheet material P to which the toner image is transferred in the transfer device 30. In the present embodiment, the fixing device 40 heats and presses the toner image in a fixing nip NF configured of a fixing belt 46 and a press roller 42, and fixes the toner image to the sheet material P.

Medium Transport Portion 50

As shown in FIG. 8, the medium transport portion 50 is configured to include a medium supply portion 52 which supplies the sheet material P to the image forming portion 16, and a medium discharging portion 54 which discharges the sheet material P on which the image is formed. In addition, the medium transport portion 50 is configured to include a medium returning portion 58 which is used when the images are formed on both surfaces of the sheet material P, and an intermediate transport portion 59 which transports the sheet material P from the transfer device 30 to the fixing device 40.

The medium supply portion 52 includes a sheet feeding device 70 in which the sheet materials P are stacked. Moreover, the sheet materials stacked on the sheet feeding device 70 are fed to the transfer nip NT one by one in accordance with a transfer timing at the transfer nip NT. Moreover, the sheet feeding device 70 will be described in detail below.

On the other hand, the medium discharging portion 54 discharges the sheet material P, to which the toner image is fixed by the fixing device 40, to the outside of the apparatus. Moreover, the medium returning portion 58 inverts the front and rear of the sheet material P when an image is formed on the other surface of the sheet material P in which the toner image is fixed to one surface, and returns the inverted sheet material to the image forming portion 16 (medium supply portion 52).

Post-Processing Portion 60

As shown in FIG. 8, the post-processing portion 60 is disposed in the inner portion of the second housing 14, and is configured to include a medium cooling portion 62 which cools the sheet material P on which the image is formed, a correction device 64 which corrects a curve of the sheet material P, and an image inspection portion 66 which inspects the image.

In addition, each portion configuring the post-processing portion 60 is disposed in the medium discharging portion 54 of the medium transport portion 50, and the medium cooling portion 62, the correction device 64, and the image inspection portion 66 are disposed in this order from the upstream side in the discharging direction of the sheet material P.

Image Forming Operation

Next, outlines of an image forming process and a post-processing process to the sheet material P by the image forming apparatus 10 will be described.

The control portion 68, which receives an image forming command, operates the toner image forming portion 20, the transfer device 30, and the fixing device 40. Accordingly, developing rollers (the reference numerals are omitted) included in the photosensitive drum 21 and the developing device 24 are rotated, and thus, the transfer belt 31 is circulated. In addition, the press roller 42 is rotated, and the fixing belt 46 is circulated. Moreover, in synchronization with the operation, the control portion 68 operates the medium transport portion 50 or the like.

Accordingly, the photosensitive drum 21 for each color is charged by the charging unit 22 while being rotated. In addition, the control portion 68 sends the image data, which is subject to image processing by the image signal processing portion, to the exposure device 23 for each color. The exposure device 23 for each color emits the exposure light L for each color according to the image data, and exposes the charged photosensitive drum 21 for each color. Moreover, an electrostatic latent image is formed on the outer circumferential surface of the photosensitive drum 21 for each color. The electrostatic latent image formed on the photosensitive drum 21 for each color is developed as the toner image by the developer G supplied from the developing device 24. Accordingly, among yellow (Y), magenta (M), cyan (C), and black (K), the toner image of the corresponding color is formed on the photosensitive drum 21 for each color.

Moreover, the toner images for each color formed on the photosensitive drums 21 for each color are sequentially transferred to the transfer belt 31 which is circulated by the primary image transfer rollers 33 for each color. Accordingly, an overlapped toner image, in which the toner images of four colors are overlapped, is formed on the transfer belt 31. The overlapped toner image is transported to the transfer nip NT by the circulation of the transfer belt 31. The sheet material P is supplied to the transfer nip NT by the medium supply portion 52 in accordance with the timing of the transport of the overlapped toner image. In the transfer nip NT, a transfer voltage is applied to the secondary image transfer roller 34, and thus, the toner image is transferred from the transfer belt 31 to the sheet material P.

The sheet material P, to which the toner image is transferred, is transported from the transfer nip NT of the transfer device 30 toward the fixing nip NF of the fixing device 40 by the intermediate transport portion 59 while being sucked by a negative pressure. The fixing device 40 applies heat and a pressurizing force (fixing energy) to the sheet material P passing through the fixing nip NF. Accordingly, the toner image transferred to the sheet material P is fixed to the sheet material P.

The sheet material P discharged from the fixing device 40 is subjected to the processing by the post-processing portion 60 while being transported toward a discharged medium receiving portion outside the apparatus by the medium discharging portion 54. First, the sheet material P heated by the fixing device 40 is cooled by the medium cooling portion 62. Next, the curve of the sheet material P is corrected by the correction device 64. In addition, in the toner image fixed to the sheet material P, the presence or absence or a degree of toner concentration defects, image defects, image position defects, or the like is detected by the image inspection portion 66. Moreover, the sheet material P is discharged to the outside of the second housing 14 by the medium discharging portion 54.

Meanwhile, when an image is formed on a non-imaged surface (rear surface) of the sheet material P on which the image is not formed (when duplex printing is performed), the control portion 68 switches the transport path of the sheet material P passing through the image inspection portion 66 from the medium discharging portion 54 to the medium returning portion 58. Accordingly, the front and rear of the sheet material P are inverted, and the sheet material is sent to the medium supply portion 52. The image is formed (fixed) on the rear surface of the sheet material P by the process similar to the above-described process, and the sheet material is discharged to the outside of the second housing 14 by the medium discharging portion 54.

Main Portion Configuration

Next, the sheet feeding device 70 or the like will be described. As shown in FIG. 8, two sheet feeding devices 70 are provided to be arranged in the up-down direction of the apparatus, and two sheet feeding devices 70 have the similar configuration. Accordingly, here, one sheet feeding device 70 will be described.

The sheet feeding device 70 is drawn to the front side in the depth direction of the apparatus with respect to the first housing 12. Moreover, in a state where the sheet feeding device 70 is drawn from the first housing 12, a user may stack the sheet material P on the sheet feeding device 70.

Moreover, a transport roller 72, which comes into contact with the uppermost sheet material P among the sheet materials P stacked on the sheet feeding device 70 and transports (supplies) the uppermost sheet material P by the rotation of the transport roller, is provided above the sheet feeding device 70 which is mounted on the first housing 12.

Sheet Feeding Device 70

Figure 6:
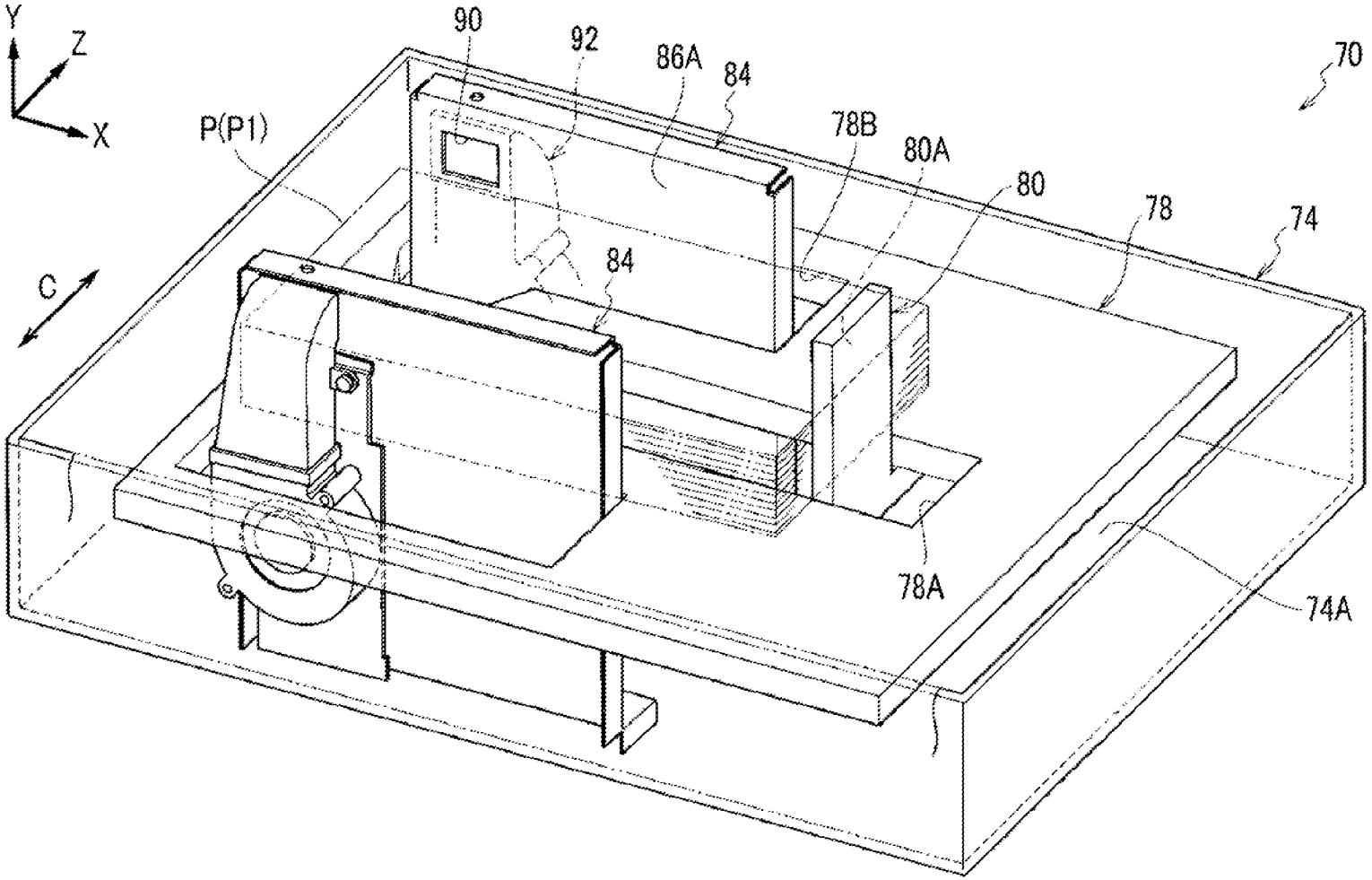
FIG. 6 is a perspective view showing the sheet feeding device according to the first exemplary embodiment of the present invention.

As shown in FIG. 6, the sheet feeding device 70 includes a box member 74 in which the upper portion is opened, and a bottom plate 78 which is disposed in the inner portion of the box member 74 and is a stacking plate on which the sheet material P is stacked. In addition, the sheet feeding device 70 includes a lifting and lowering unit (not shown) which lifts and lowers the bottom plate 78, the bottom plate 78 is lifted by the lifting and lowering unit in the state where the sheet feeding device 70 is mounted on the first housing 12, and thus, the uppermost sheet material P stacked on the bottom plate 78 comes into contact with the transport roller 72.

Meanwhile, in a state where the sheet feeding device 70 is drawn from the first housing 12, the bottom plate 78 is lowered by the lifting and lowering unit, and the user may stack the sheet material P on the bottom plate 78. In addition, FIG. 6 shows the state where the bottom plate 78 is lowered.

End Guide

Moreover, the sheet feeding device 70 includes an end guide 80 which abuts the rear end portion (right end portion in the drawing) of the sheet material P stacked on the bottom plate 78, and thereby arranges the stacking position in a transport direction (an arrow B in the drawing: hereinafter, simply referred to as a "sheet material transport direction") of the sheet material P in the bottom plate 78.

The end guide 80 is disposed at the center side in the width direction (C direction in the drawing: hereinafter, simply referred to as a "sheet martial width direction") of the sheet material P stacked on the bottom plate 78 in the inner portion of the box member 74. Moreover, the end guide 80 includes a plate surface 80A which is directed to the downstream side in the sheet material transport direction, and is mounted on a bottom plate 74A of the box member 74 so as to be moved in the sheet material transport direction. In addition, a clearance hole 78A extending in the sheet material transport direction is formed on the bottom plate 78 so that the end guide 80 is movable.

In this configuration, the plate surface 80A of the end guide 80 abuts the rear end portion of the stacked sheet material P, and thus, the stacking position in the sheet material transport direction of the sheet material P stacked on the bottom plate 78 is not deviated.

Side Guide 84

In addition, the sheet feeding device 70 includes a side guide 84 which is an example of a first arrangement member which abuts the end portion in the sheet material width direction of the sheet material P stacked on the bottom plate 78 and arranges the stacking position in the sheet material width direction of the sheet material P.

Two side guides 84 are disposed to oppose each other in the sheet material width direction, and are disposed at the downstream side in the sheet material transport direction in the inner portion of the box member 74. Each of two side guides 84 has a symmetrical structure, and one side guide 84 includes a plate surface 86A which is directed to the other side guide.

Each of the side guides 84 is mounted on the bottom plate 74A of the box member 74 to be moved in the sheet material width direction. In addition, a clearance hole 78B is formed on the bottom plate 78 so that the side guides 84 are movable. Moreover, a movement unit (not shown), by which the other side guide 84 is also similarly moved if one side guide 84 is moved, is provided, and thus, the center position of the sheet material P is stacked at the center position of the bottom plate 78 (a so-called center register method). Moreover, when a small guide 100 described below is mounted on the side guide 84, a portion of the clearance hole 78B extends to the inner side (the side on which the sheet material P is stacked) in the sheet material width direction so that the bottom plate 78 and the small guide 100 do not interfere with each other (refer to FIG. 2).

As described above, since two side guides 84 have the similar configuration, in descriptions below, only one side guide 84 will be described.

Figure 1A:
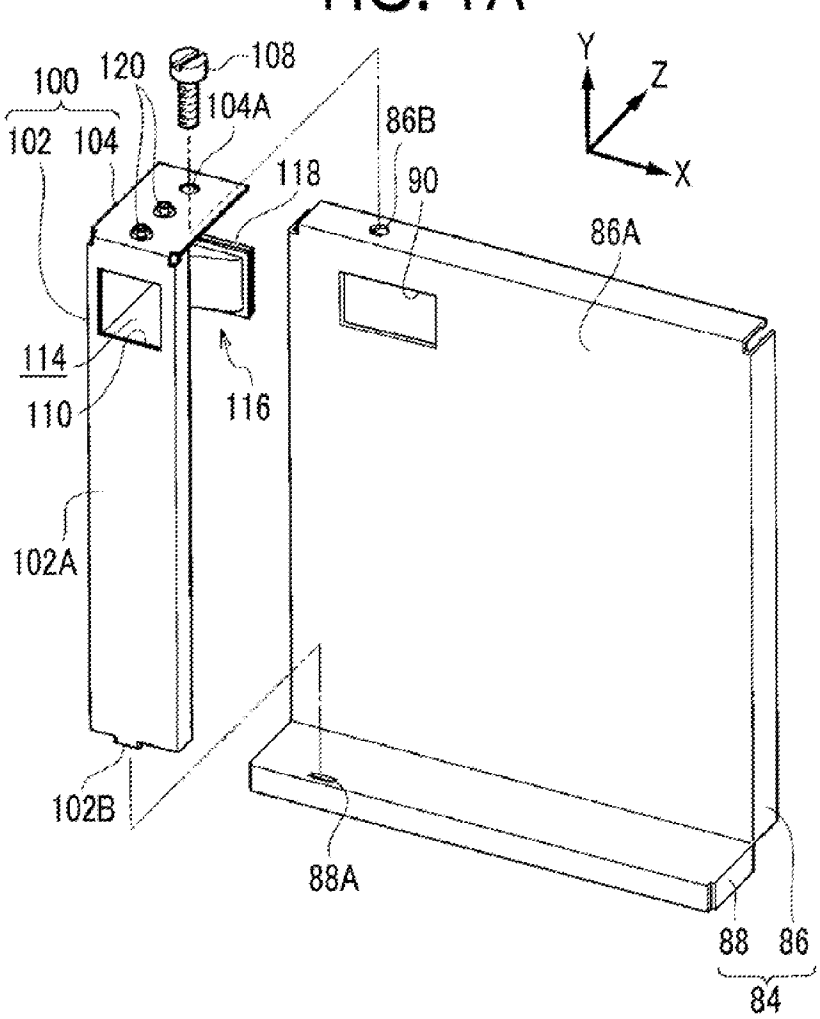

As shown in FIGS. 1A and 1B, the side guide 84 is formed by bending a sheet metal member, and includes a rising portion 86 extending in the up-down direction, and an upward portion 88 which is connected to the lower end of the rising portion 86 and in which the plate surface faces upward. In addition, as described above, the side on which the sheet material P is stacked in the rising portion 86 becomes the plate surface 86A abutting the end portion in the width direction of the stacked sheet material P.

In addition, an insertion hole 88A used to mount the small guide 100 described below is formed on the upward portion 88. The insertion hole 88A is disposed in the downstream side in the sheet material transport direction on the upward portion 88.

In addition, a screw hole 86B used to mount the small guide 100 is formed on a flange, which is formed on the rising portion 86, toward the upper portion. The screw hole 86B is disposed at the upper portion in the rising portion 86 and the downstream side in the sheet material transport direction.

In addition, as an example of a first blown-out port from which air sprayed to the end portion in the width direction of the sheet material P including the stacked uppermost sheet material P is blown out, a blown-out port 90 is formed on the plate surface 86A of the rising portion 86. The blown-out port 90 is formed in a rectangular shape and is disposed below the screw hole 86B (refer to FIG. 5).

Figure 4:
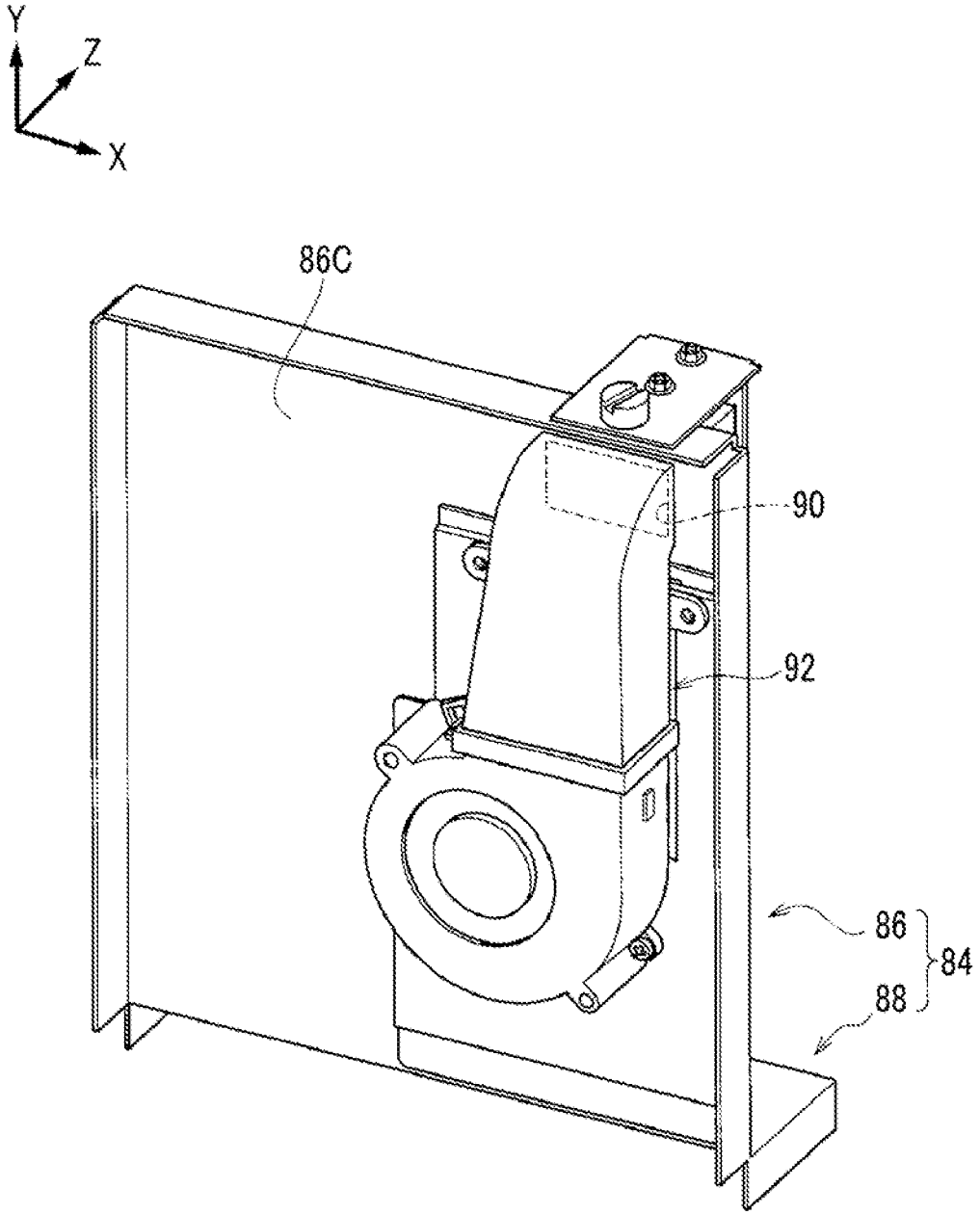
FIG. 4 is a perspective view showing a blower used in the sheet feeding device according to the first exemplary embodiment of the present invention.
Figure 5:
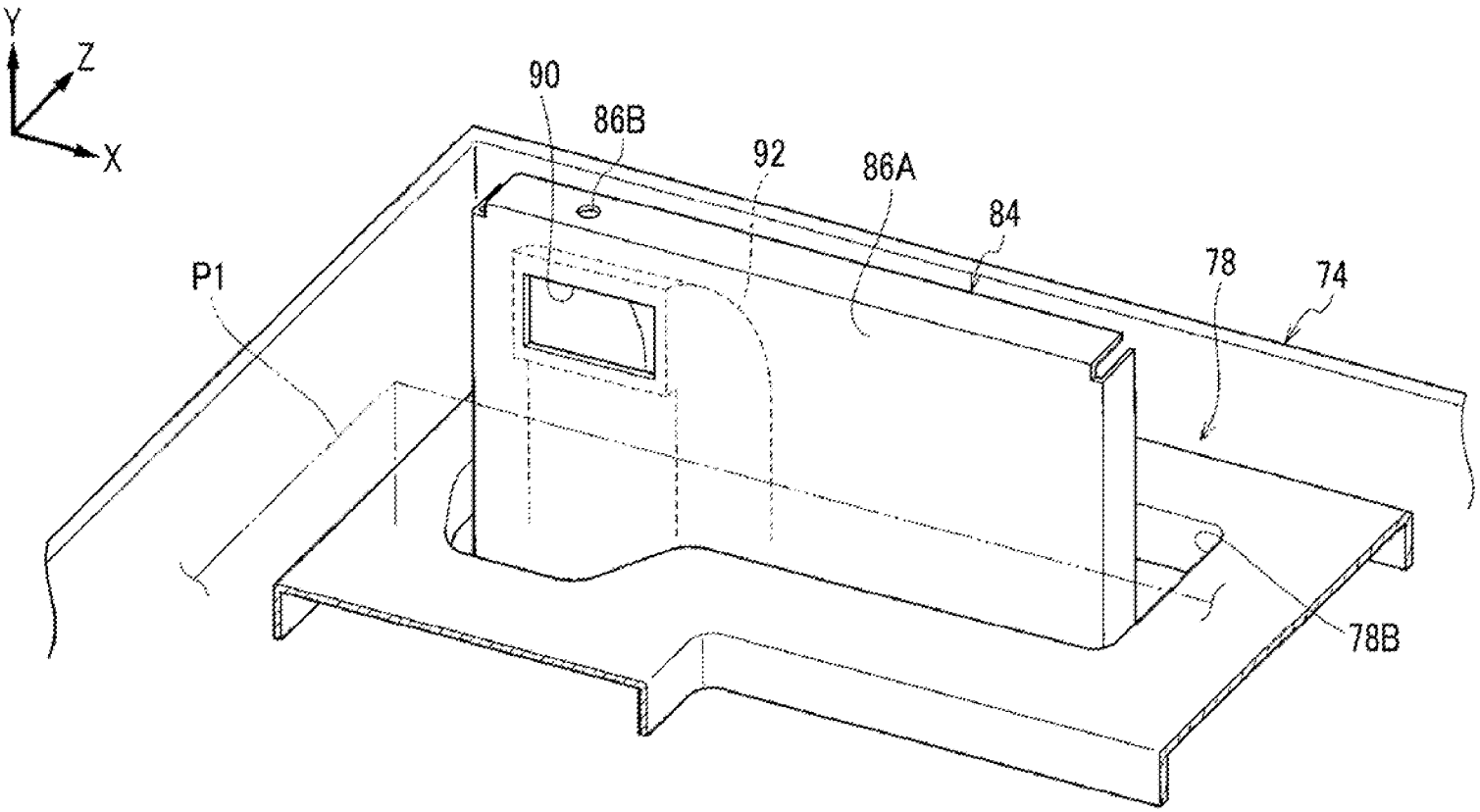
FIG. 5 is an enlarged perspective view showing the side guide used in the sheet feeding device according to the first exemplary embodiment of the present invention.

In addition, as shown in FIG. 4, a blower 92, which blows air from the blown-out port 90 in the sheet width direction, is mounted on a surface 86C opposite to the plate surface 86A in the rising portion 86.

Small Guide 100

In addition, the sheet feeding device 70 includes the small guide 100 which is an example of a second arrangement member which is mounted to be attached to and detached from the side guide 84 and is disposed on the side on which the sheet material P is disposed in the side guide 84. The small guide 100 mounted on the side guide 84 abuts the end portion in the sheet material width direction of a small sheet material P (for example, a postal card or the like) having a narrower width than the sheet material P (for example, A4 size) arranged by the side guide 84, and arranges the position in the sheet material width direction of the small sheet material P. When a small sheet material P, which has a small size such as a postal card which is not arranged (is not abutted) even when the side guide 100 is moved to the inner side within the movable range, is supplied, the small side guide 100 is used.

In descriptions below, the sheet material P arranged by the side guide 84 is referred to as a sheet material P1, and a small sheet material arranged by the small guide 100 is referred to as a small sheet material P2.

As shown in FIGS. 1A and 1B, the small guide 100 is formed by bending a sheet metal member, and includes a rising portion 102 extending in the up-down direction and an upward portion 104 which is connected to the upper end of the rising portion 102 and in which the plate surface faces upward.

In addition, the side on which the small sheet material P2 is stacked in the rising portion 102 becomes a plate surface 102A which abuts the end portion in the width direction of the stacked small sheet material P2. An insertion claw 102B which is inserted into the above-described insertion hole 88A is formed on the lower end of the rising portion 102.

Moreover, circular holes 104A are formed at the outside (the side opposite the side on which the small sheet material P2 is stacked) in the sheet material width direction in the upward portion 104. The insertion claw 102B is inserted into the insertion hole 88A, a screw 108 passes through the circular hole 104A, the screw 108 is fastened to the screw hole 86B, and thus, the small guide 100 is mounted on the side guide 84 (refer to FIG. 1B).

In addition, as an example of a second blown-out port from which air sprayed to the end portion in the width direction of the small sheet material P2 including the stacked uppermost small sheet material P2 is blown out, a blown-out port 110 is formed on the rising portion 102. The blown-out port 110 is formed in a rectangular shape and is disposed at the upper portion in the rising portion 102. A blown-out area of the blown-out port 110 is smaller than a blown-out area of the blown-out port 90 of the side guide 84. The blown-out area is an area from which the air is blown out, and when an outlet area of an air duct 116 described below is smaller than the area of the blown-out port 110, the blown-out area corresponds to the outlet area of the air duct 116 described below.

Air Duct 116

As shown in FIGS. 1A and 1B, the sheet feeding device 70 includes the air duct 116 which is an example of a passage member in which a passage 114 introducing the air blown out from the blown-out port 90 into the blown-out port 110 is formed.

The air duct 116 is mounted on the upward portion 104 of the small guide 100 in advance using two screws 120. In the state where the small guide 100 is mounted on the side guide 84, the air duct 116 includes a seal member 118 (refer to FIG. 3) which comes into contacting with the plate surface 86A.

Figure 3:
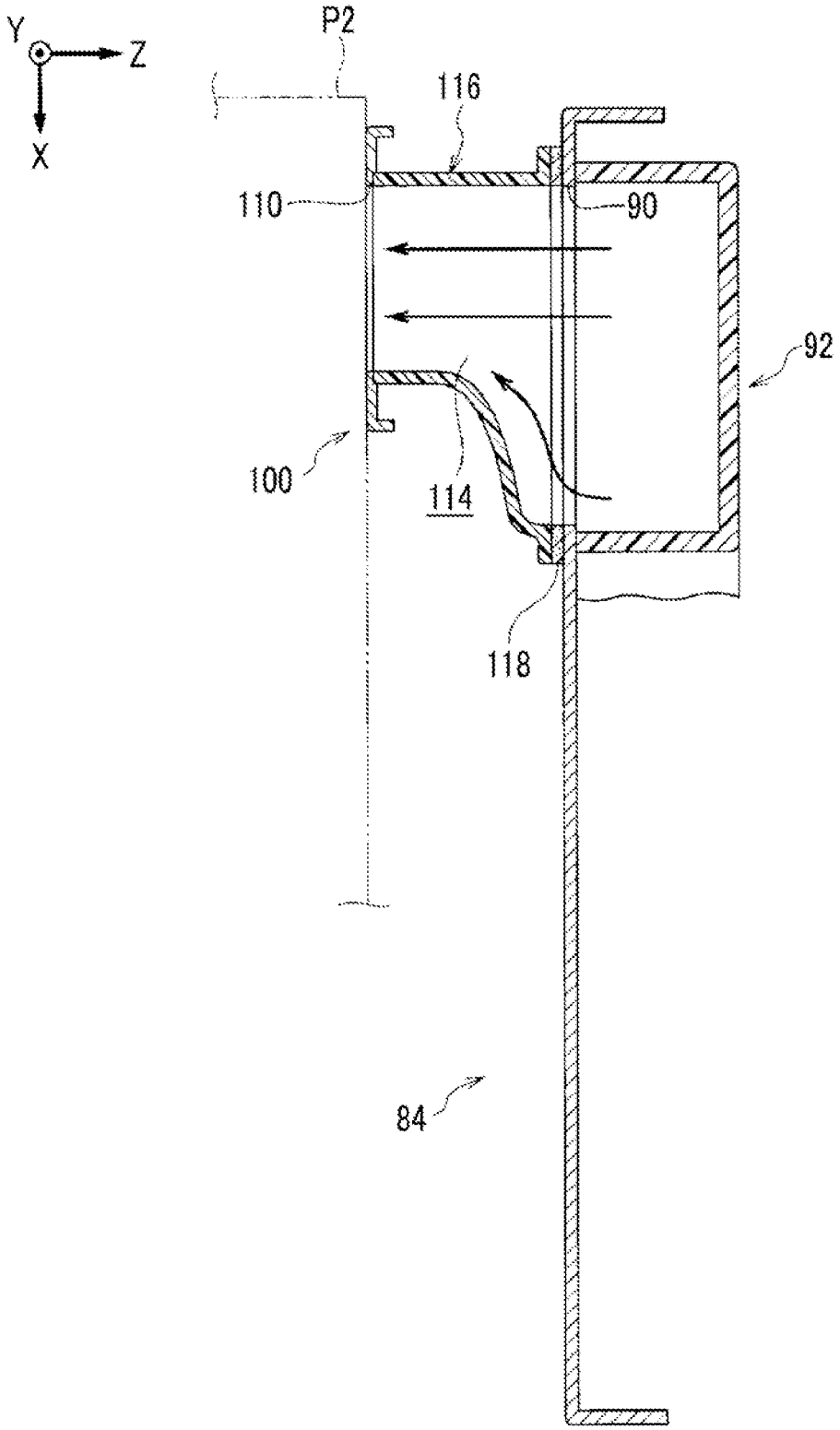
FIG. 3 is a cross-sectional view showing the side guide and the small guide used in the sheet feeding device according to the first exemplary embodiment of the present invention.

As described above, since the blown-out area of the blown-out port 110 is smaller than the blown-out area of the blown-out port 90, as shown in FIG. 3, the passage 114 of the air duct 116 is narrowed from the blown-out port 90 toward the blown-out port 110. An outlet of the air duct 116 is directed to the blown-out port 110.

Operation of Main Portion Configuration

Next, the case in which the small sheet material P2 having a smaller size than the sheet material P1 arranged by the side guide 84 is stacked on the sheet feeding device 70 will be described.

When the small sheet material P2 is stacked on the bottom plate 78 of the sheet feeding device 70, the sheet feeding device 70 is drawn from the first housing 12, and as shown in FIGS. 1A and 1B, the small guide 100 is mounted on the side guide 84.

Figure 2:
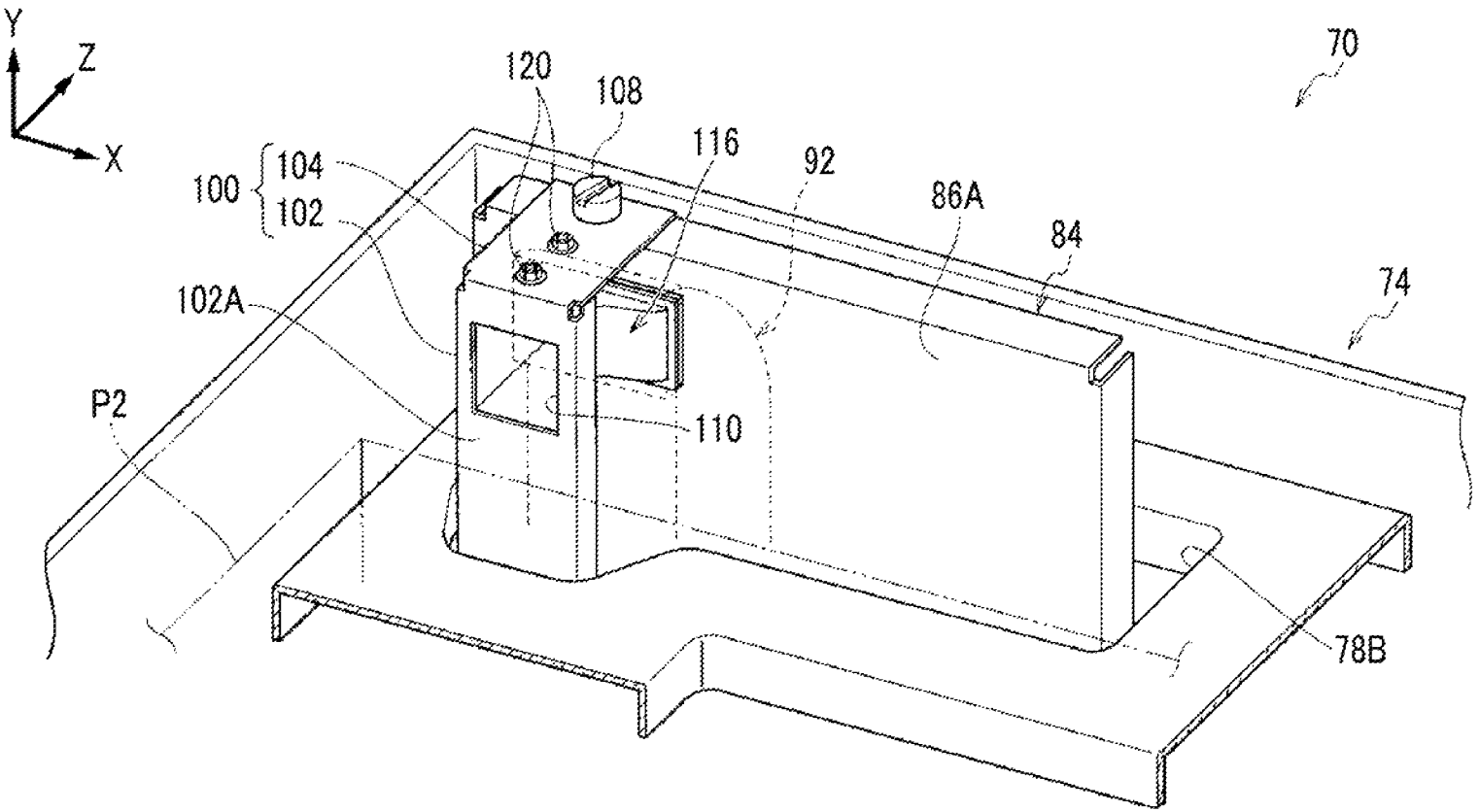
FIG. 2 is an enlarged perspective view showing the side guide and the small guide used in the sheet feeding device according to the first exemplary embodiment of the present invention.

Moreover, the small sheet material P2 is stacked on the bottom plate 78, and as shown in FIG. 2, the plate surface 102A of the small guide 100 abuts the end portion in the width direction of the stacked small sheet material P2, and the stacking position in the sheet material width direction of the small sheet material P2 is arranged.

In this state, when the sheet feeding device 70 is mounted on the first housing 12, the bottom plate 78 is lifted by the lifting and lowering unit, and the uppermost small sheet material P2 stacked on the bottom plate 78 comes into contact with the transport roller 72. Moreover, the end portion in the sheet material width direction of the upper side small sheet material P2 in the stacked sheet material P opposes the blown-out port 110.

The blower 92 is operated, and thus, air is blown out from the blown-out port 90 of the side guide 84. As shown in FIG. 3, the air blown out from the blown-out port 90 is blown out from the blown-out port 110 through the passage 114 of the air duct 116. The air blown out from the blown-out port 110 is sprayed to the end portion in the sheet material width direction of the small sheet material P2.

Here, since the air blown out from the blown-out port 90 is introduced to the blown-out port 110 by the air duct 116, an amount of the air, which is blown out from the blown-out port 110, per unit time is increased compared to when the air duct 116 is not used.

Accordingly, the air sprayed to the end portion in the sheet material width direction of the small sheet material P2 enters between the stacked small sheet materials P2, and separates the small sheet materials. In other words, sticking between the small sheet materials is suppressed.

Conclusion of Main Portion Configuration

As described above, when the small sheet material P2 is used, the sticking between the small sheet materials is suppressed by using the air duct 116.

In addition, as described above, the blown-out area of the blown-out port 110 is smaller than the blown-out area of the blown-out port 90. Accordingly, a flow velocity of the air blown out from the blown-out port 110 is higher than the flow velocity of the air blown out from the blown-out port 90. Accordingly, the air sprayed to the end portion in the sheet material width direction of the small sheet material P2 effectively enters between the stacked small sheet materials P2. In this way, the sticking between the small sheet materials is suppressed.

In addition, since the sticking between the small sheet materials P2 is suppressed, the small sheet material P2 is suppressed from being overlapped and transported (double fed).

Moreover, since the double feeding of the small sheet material P2 is suppressed in the image forming apparatus 10, an image is formed on each small sheet material P2 which is transported.

Second Exemplary Embodiment

Next, examples of a sheet feeding device and an image forming apparatus according to a second exemplary embodiment of the present invention will be described with reference to FIGS. 9 to 11. Moreover, the same reference numerals are assigned to the same members as the first exemplary embodiment, the descriptions thereof are omitted, and portions different from the first exemplary embodiment are mainly described.

Figure 11:
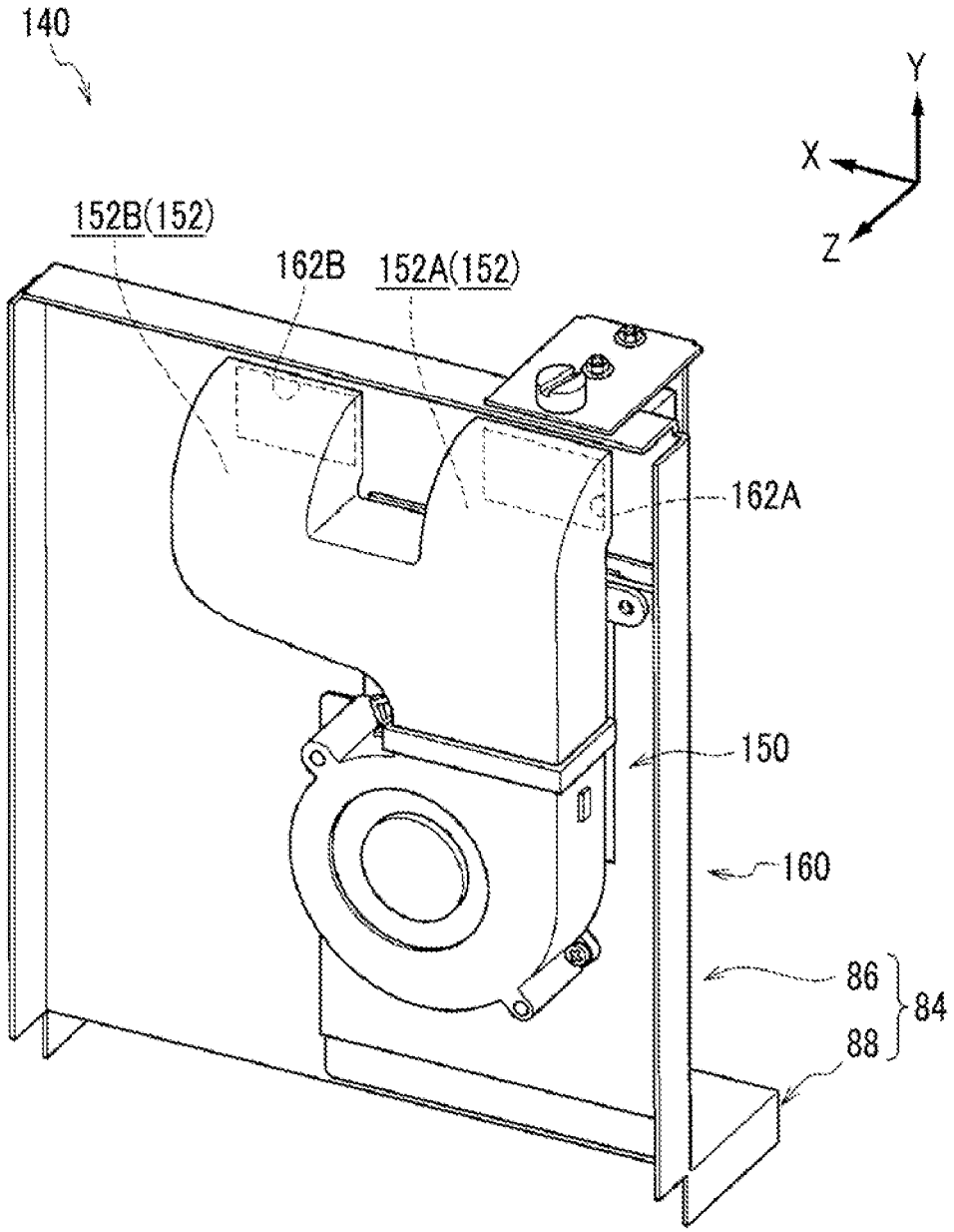
FIG. 11 is a perspective view showing a blower used in the sheet feeding device according to the second exemplary embodiment of the present invention.

As shown in FIG. 11, a blower 150 used in a sheet feeding device 140 of the second exemplary embodiment includes two blowing passages 152 which feed air.

The two blowing passages 152 are disposed to be arranged in the sheet material transport direction, and are configured to include a first blowing passage 152A and a second blowing passage 152B which is disposed at the downstream side in the sheet material transport direction with respect to the first blowing passage 152A.

In addition, a blown-out port 162A (an example of a first blown-out port) from which the air fed from the first blowing passage 152A is blown out, and a blown-out port 162B from which the air fed from the second blowing passage 152B is blown out are formed on the side guide 84. The blown-out area of the blown-out port 110 is smaller than the blown-out area of the blown-out port 162A.

Figure 9:
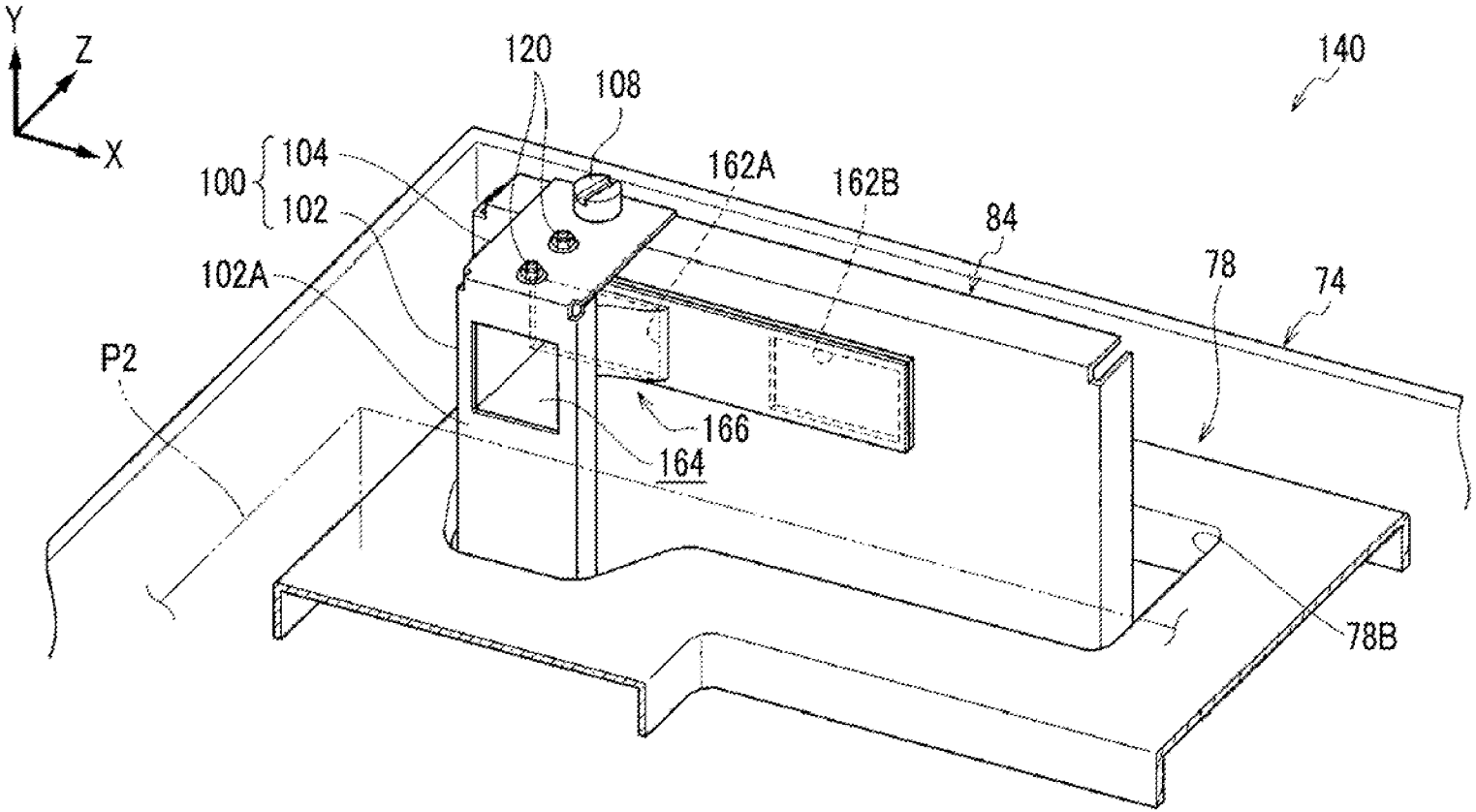
FIG. 9 is an enlarged perspective view showing a side guide and a small guide used in a sheet feeding device according to a second exemplary embodiment of the present invention.
Figure 10:
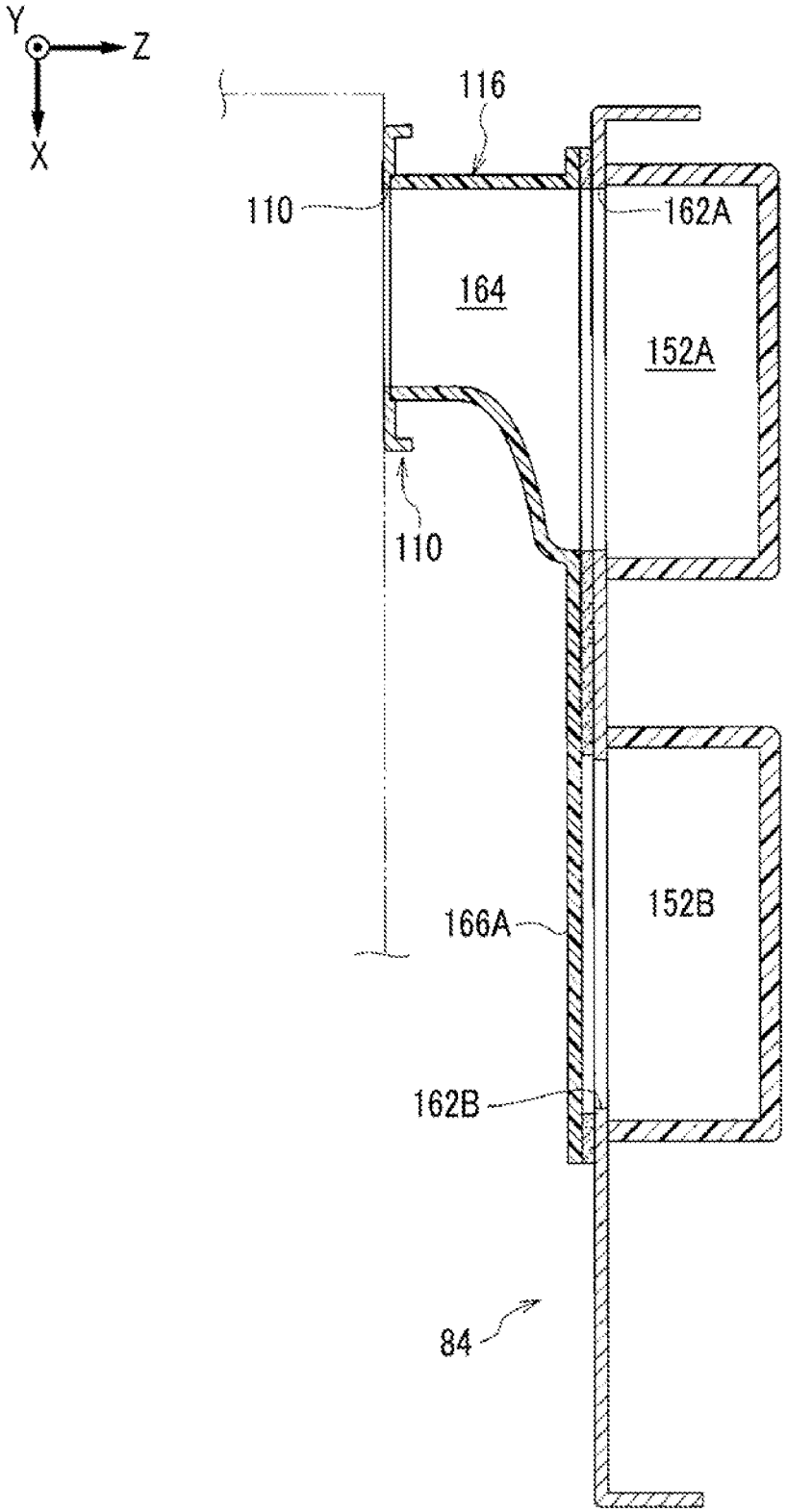
FIG. 10 is a cross-sectional view showing the side guide and the small guide used in the sheet feeding device according to the second exemplary embodiment of the present invention.

Moreover, as shown in FIGS. 9 and 10, in a state where the small guide 100 is mounted on the side guide 84, a passage 164 which introduces the air blown out from the blown-out port 162A to the blown-out port 110 is formed on an air duct 166 (an example of the passage member). In addition, a closing portion 166A which closes the blown-out port 162B is formed on the air duct 166.

Effects of the second exemplary embodiment are similar to those of the first exemplary embodiment.

In addition, specific exemplary embodiments of the present invention are described in detail. However, the present invention is not limited to the exemplary embodiments, and it is obvious that various exemplary embodiments of the present invention are possible within the scope of the present invention by those skilled in the art. For example, in the exemplary embodiment, the blown-out area of the blown-out port 110 is smaller than the blown-out area of the blown-out port 90. However, the blown-out areas may be the same as each other, and the blown-out area of the blown-out port 110 may be larger than the blown-out area of the blown-out port 90. In a case that the blown-out areas are the same as each other, the flow velocity of the air blown out from the blown-out port 110 is the same as the flow velocity of the air blown out from the blown-out port 90, and the sticking between the small sheet materials is effectively suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet feeding device comprising:

a first arrangement member that abuts an end portion in a width direction of a fed and stacked sheet material, arranges the width direction of the sheet material, and forms a first blown-out port from which air sprayed to the end portion in the width direction of the sheet material is blown out;

a second arrangement member that is mounted on the first arrangement member, is disposed in a sheet material side with respect to the first arrangement member, abuts an end portion in a width direction of a small sheet material having a narrower width than the sheet material arranged by the first arrangement member, arranges the width direction of the small sheet material, and forms a second blown-out port from which air sprayed to the end portion in the width direction of the stacked small sheet material is blown out; and a passage member that forms a passage introducing the air blown out from the first blown-out port to the second blown-out port, wherein the second arrangement member is arranged to be detachable and attachable to the first arrangement member, wherein the passage member is disposed on the second arrangement member, and wherein the passage member is formed in a tubular shape.

2. The sheet feeding device according to claim 1, wherein a blown-out area of the second blown-out port is smaller than or equal to a blown-out area of the first blown-out port.

3. An image forming apparatus comprising:

the sheet feeding device according to claim 1; and an image forming portion that forms an image on a sheet material fed by the sheet feeding device.

4. An image forming apparatus comprising:

the sheet feeding device according to claim 2; and an image forming portion that forms an image on a sheet material fed by the sheet feeding device.

5. A sheet feeding device according to claim 1, wherein the passage member covers the first blown-out port.

6. A sheet feeding device comprising:

a first arrangement member that abuts an end portion in a width direction of a fed and stacked sheet material, arranges the width direction of the sheet material, and forms a first blown-out port from which air sprayed to the end portion in the width direction of the sheet material is blown out;

a second arrangement member that is detachably and attachably mountable on the first arrangement member, is disposed at a sheet material side with respect to the first arrangement member, abuts an end portion in a width direction of a small sheet material having a narrower width than the sheet material arranged by the first arrangement member, arranges the width direction of the small sheet material, and forms a second blown-out port from which air sprayed to the end portion in the width direction of the stacked small sheet material is blown out; and a passage member that is disposed on the second arrangement member, is formed in a tubular shape, and forms a passage introducing the air blown out from the first blown-out port to the second blown-out port.

* * * * *